US010182676B2

(12) United States Patent
Schlief et al.

(10) Patent No.: US 10,182,676 B2
(45) Date of Patent: Jan. 22, 2019

(54) COLLAPSIBLE PARTY TRAY

(71) Applicant: D&B Joint Ventures, LLC, Austin, TX (US)

(72) Inventors: Barbara A. Schlief, Austin, TX (US); Dwain A Osborne, Austin, TX (US)

(73) Assignee: D&B Joint Ventures, LLC, Austin, TX (US)

( * ) Notice: Subject to any disclaimer, the term of this patent is extended or adjusted under 35 U.S.C. 154(b) by 156 days.

(21) Appl. No.: 14/515,926

(22) Filed: Oct. 16, 2014

(65) Prior Publication Data

US 2016/0107791 A1 Apr. 21, 2016

(51) Int. Cl.
*A47G 23/06* (2006.01)
*B31B 1/00* (2006.01)

(52) U.S. Cl.
CPC ..... *A47G 23/06* (2013.01)

(58) Field of Classification Search
CPC ..... A47G 23/06
USPC ..... 493/68
See application file for complete search history.

(56) References Cited

U.S. PATENT DOCUMENTS 1,670,498 A * 5/1928 Einson ..... B65D 5/4204 206/419
2,118,821 A * 5/1938 Ringler ..... A63H 33/16 229/103
4,055,250 A * 10/1977 Mayhew ..... B65D 81/368 206/457
4,245,773 A * 1/1981 Stollberg ..... B65D 5/003 206/509
4,483,455 A * 11/1984 Prophet, Jr. ..... A47G 23/06 220/23.83
4,708,256 A * 11/1987 Intardonato ..... A47G 23/06 220/23.4
4,757,937 A * 7/1988 Maio ..... B65D 5/3635 206/562

(Continued)

OTHER PUBLICATIONS

"Fire Engine Trucks Cardboard Kids Food Box Lunch Serving Tray Party Planner", http://www.ebay.com/itm/6-Fire-Engine-Trucks-Cardboard-Kids-Food-Box-Lunch-Serving-Tray-Party-Planner-/360877541162?_trksid=p2054897.I4275, Jun. 4, 2014.

(Continued)

*Primary Examiner* — Sameh Tawfik
(74) *Attorney, Agent, or Firm* — Meyertons, Hood, Kivlin, Kowert & Goetzel, P.C.

(57) ABSTRACT

In some embodiments, a system and/or method may include a food tray kit. In some embodiments, the food tray kit may include a platform, a plurality of first foldable containers, a plurality of second foldable containers, and a third container. The plurality of first foldable containers may be couplable to the platform. At least some of the plurality of first foldable containers may contain, during use, food. At least some of the plurality of first foldable containers may include an opening cut at an angle to resemble a portion of a sports entertainment stadium. The plurality of second foldable containers may be couplable to the platform. At least some of the plurality of second foldable containers may contain, during use, at least one food container. The third container may be formed by the platform and at least some of the plurality of first foldable containers when coupled to the platform.

7 Claims, 15 Drawing Sheets

(56) References Cited

U.S. PATENT DOCUMENTS 4,979,667 A * 12/1990 Seaman ..... B65D 5/2033 229/109
5,055,083 A * 10/1991 Walker ..... A63H 33/044 446/476
5,141,149 A * 8/1992 Fulton ..... B65D 5/003 206/423
5,335,804 A * 8/1994 Flory ..... A47B 77/16 211/78
5,421,459 A * 6/1995 Mazzotti ..... A47G 19/065 206/549
5,423,709 A * 6/1995 Summers ..... A63H 3/52 446/108
5,452,845 A * 9/1995 Ritter ..... B65D 5/20 229/110
5,542,870 A * 8/1996 Westersund ..... A63H 33/42 220/324
5,649,654 A * 7/1997 Hayward, Jr. ..... A45F 5/00 108/43
D382,228 S * 8/1997 Snook ..... D11/131
5,775,061 A * 7/1998 Enneking ..... A61G 17/00 53/445
D426,402 S * 6/2000 Rutledge ..... D6/678.2
6,146,238 A * 11/2000 Daiber ..... A63H 33/00 446/476
6,149,011 A * 11/2000 Csengeri ..... A47G 19/06 206/541
D444,301 S * 7/2001 Wolf ..... D3/271.3
6,401,927 B1 * 6/2002 Sorensen ..... A47G 19/06 206/216
6,712,214 B1 * 3/2004 Wintermute ..... B65D 5/003 206/509
D517,374 S 3/2006 Robinson
D566,540 S 4/2008 Llewellyn et al.
D567,103 S * 4/2008 Llewellyn ..... D9/431
D607,696 S 1/2010 Piccolo
D687,645 S 8/2013 Tapper
8,783,548 B2 * 7/2014 Billen ..... B65D 5/425 229/116.4
8,808,050 B2 * 8/2014 Goldmeier ..... A63H 33/42 446/105
D761,659 S 7/2016 Schlief et al.
D763,099 S * 8/2016 Billen ..... D21/551
2004/0195144 A1 * 10/2004 Smith ..... B65D 71/72 206/565
2008/0029643 A1 * 2/2008 Billen ..... B65D 81/368 244/1 R
2010/0044265 A1 * 2/2010 Ragsdale ..... B65D 1/36 206/518
2012/0168476 A1 7/2012 Genung
2013/0277375 A1 * 10/2013 Hickox ..... A47G 23/0633 220/575

OTHER PUBLICATIONS

"5203 Gold Medal—Concession Trays, Drive-in", http://www.jesrestaurantequipment.com/product.asp?itemid=33104&utm_source=googleshopping&gclid=CjkKEQjw5LWcBRCeh8uUlqqluN4BEiQAfr64cNp9TWFX3-0WAjmm6CTP4hVH1jE6bB2HovaaX1m7yRDw_wcB, Jun. 4, 2014.
"Ford T-Bird Cardboard Car Food Dish Snack Tray", http://www.amazon.com/T-Bird-Cardboard-Snack-Party-Planner/dp/B0093N6MMU, Jun. 4, 2014.
"BSI Products 32002 Alabama Crimson Tide Chip & Dip Tray", http://cdn.opentip.com/Sports-Outdoors/Bsi-Products-Alabama-Crimson-Tide-Chip-Dip-Tray-p-4251704.html?gclid=CjkKEQjwh7ucBRD9yY_fyZe398gBEiQAAoy4JHm8efirQz4hA5CPdj7lLBmCL3T0-n9j7nJrl4l_Os3w_wcB, Jun. 4, 2014.
Ex Parte Quayle Action for Design U.S. Appl. No. 29/506,509 mailed on Jan. 29, 2016.

* cited by examiner

COLLAPSIBLE PARTY TRAY

BACKGROUND OF THE INVENTION

1. Field of the Invention

The present disclosure generally relates to food tray kits. More particularly, the disclosure generally relates to a method and system for assembling a collapsible food tray with sports themed related indicia.

2. Description of the Relevant Art

There are many methods for displaying and serving food items. For example, food items are sold curbside from carts, trucks and stands (e.g., food items are selected from menus, pictures and, like a cafeteria, from open displays of food items and are served over a counter).

There are many occasions where individuals want to assemble and eat, such as sponsored events, sporting events, picnics, club outings and the like. During these events food (e.g., meat) is frequently cooked on grills, as well as other prepared food items are prepared and brought to the event. In these instances the food items are generally brought in containers which have been filled with the food items as they were prepared and brought separately to the outing or party in the bowls and served from the bowls in which they were brought.

There are a number of products for holding snacks, drinks, and/or chips and dip. Some of these solutions have themed indicia. Snack trays are popular items at commercial and private parties. However, large scale themed party snack trays which are disposable and easily transportable are not currently available.

SUMMARY

In some embodiments, a system and/or method may include a food tray kit. In some embodiments, the food tray kit may include a platform, a plurality of first foldable containers, a plurality of second foldable containers, and a third container. The plurality of first foldable containers may be couplable to the platform. At least some of the plurality of first foldable containers may contain, during use, food. At least some of the plurality of first foldable containers may include an opening cut at an angle to resemble a portion of a sports entertainment stadium. The plurality of second foldable containers may be couplable to the platform. At least some of the plurality of second foldable containers may contain, during use, at least one food container. The third container may be formed by the platform and at least some of the plurality of first foldable containers when coupled to the platform.

BRIEF DESCRIPTION OF THE DRAWINGS

Advantages of the present invention may become apparent to those skilled in the art with the benefit of the following detailed description of the preferred embodiments and upon reference to the accompanying drawings.

Figure 1:
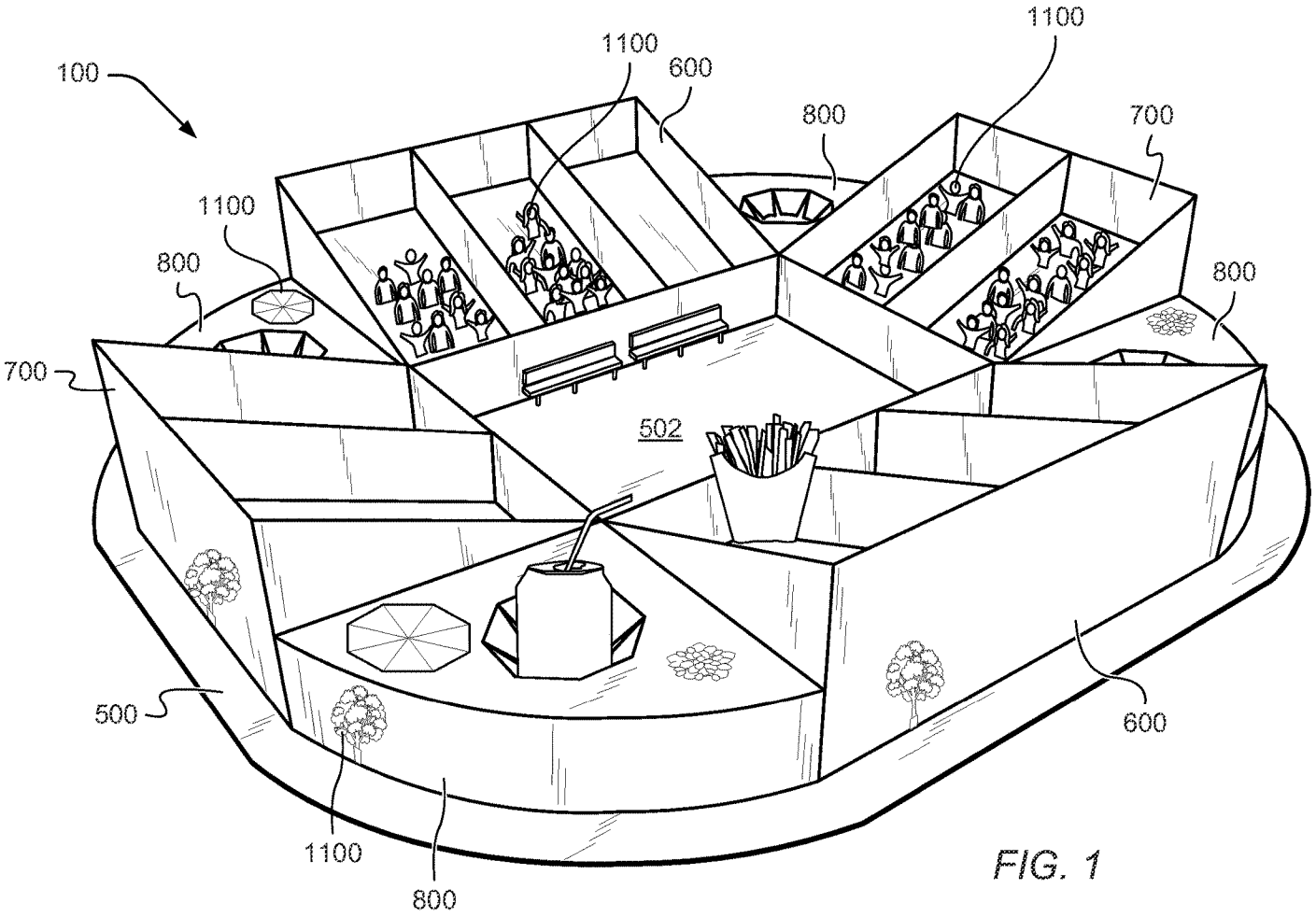
FIG. 1 depicts a perspective view of a representation of an embodiment of a food tray kit.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

The headings used herein are for organizational purposes only and are not meant to be used to limit the scope of the description. As used throughout this application, the word "may" is used in a permissive sense (i.e., meaning having the potential to), rather than the mandatory sense (i.e., meaning must). The words "include," "including," and "includes" indicate open-ended relationships and therefore mean including, but not limited to. Similarly, the words "have," "having," and "has" also indicated open-ended relationships, and thus mean having, but not limited to. The terms "first," "second," "third," and so forth as used herein are used as labels for nouns that they precede, and do not imply any type of ordering (e.g., spatial, temporal, logical, etc.) unless such an ordering is otherwise explicitly indicated.

Various components may be described as "configured to" perform a task or tasks. In such contexts, "configured to" is a broad recitation generally meaning "having structure that" performs the task or tasks during operation. As such, the component can be configured to perform the task even when the component is not currently performing that task. In some contexts, "configured to" may be a broad recitation of structure generally meaning "having circuitry that" performs the task or tasks during operation. As such, the component can be configured to perform the task even when the component is not currently on. In general, the circuitry that forms the structure corresponding to "configured to" may include hardware circuits.

Various components may be described as performing a task or tasks, for convenience in the description. Such descriptions should be interpreted as including the phrase "configured to." Reciting a component that is configured to perform one or more tasks is expressly intended not to invoke 35 U.S.C. § 112 paragraph (f), interpretation for that component.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

It is to be understood the present invention is not limited to particular devices or biological systems, which may, of course, vary. It is also to be understood that the terminology used herein is for the purpose of describing particular embodiments only, and is not intended to be limiting. As used in this specification and the appended claims, the singular forms "a", "an", and "the" include singular and plural referents unless the content clearly dictates otherwise. Thus, for example, reference to "a linker" includes one or more linkers.

DETAILED DESCRIPTION

Definitions

Unless defined otherwise, all technical and scientific terms used herein have the same meaning as commonly understood by one of ordinary skill in the art.

The term "connected" as used herein generally refers to pieces which may be joined or linked together.

The term "coupled" as used herein generally refers to pieces which may be used operatively with each other, or joined or linked together, with or without one or more intervening members.

The term "directly" as used herein generally refers to one structure in physical contact with another structure, or, when used in reference to a procedure, means that one process effects another process or structure without the involvement of an intermediate step or component.

Figure 2A:
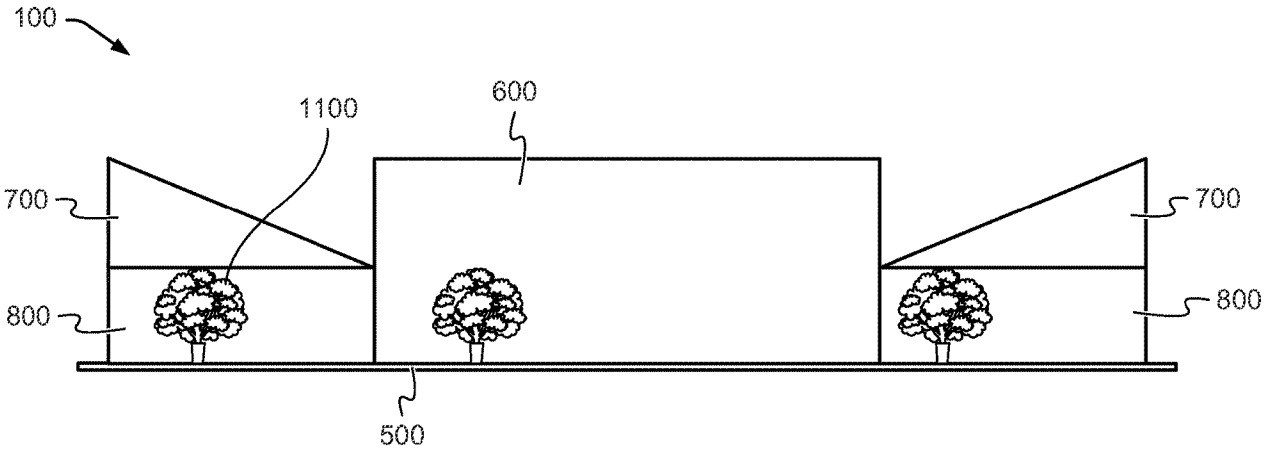
FIG. 2A depicts a front perspective view of a representation of an embodiment of a food tray kit.
Figure 2B:
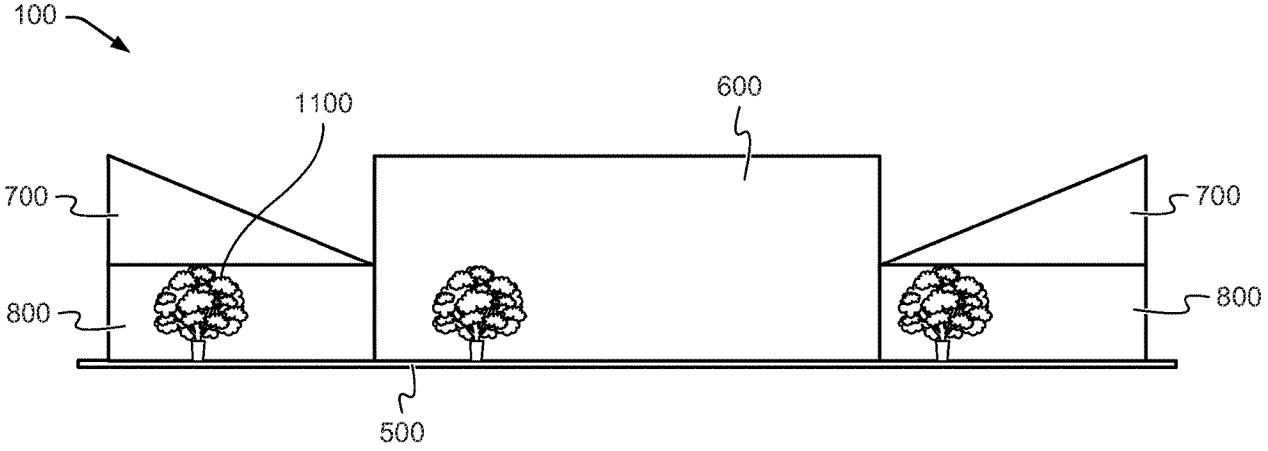
FIG. 2B depicts a rear view of a representation of an embodiment of a food tray kit.
Figure 3A:
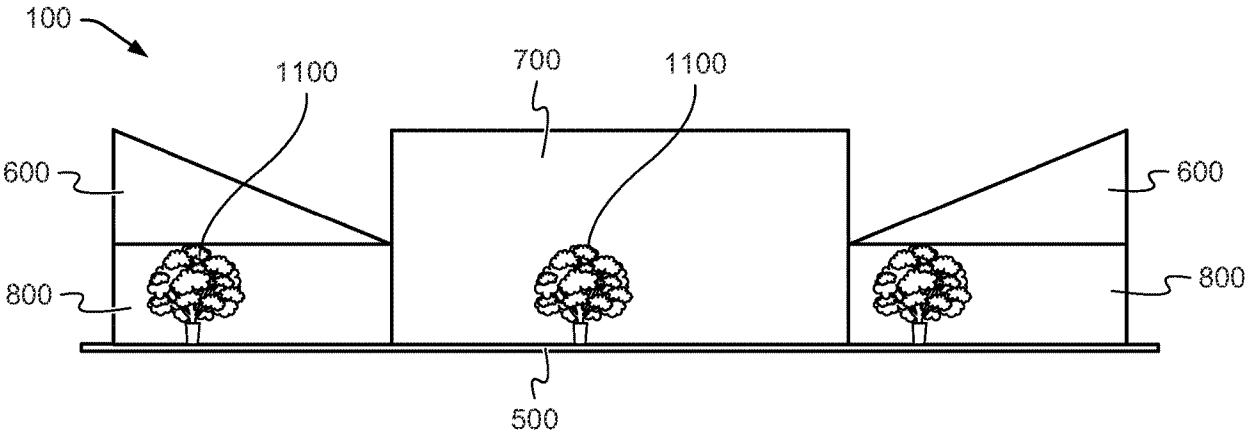
FIG. 3A depicts a left view of a representation of an embodiment of a food tray kit.
Figure 3B:
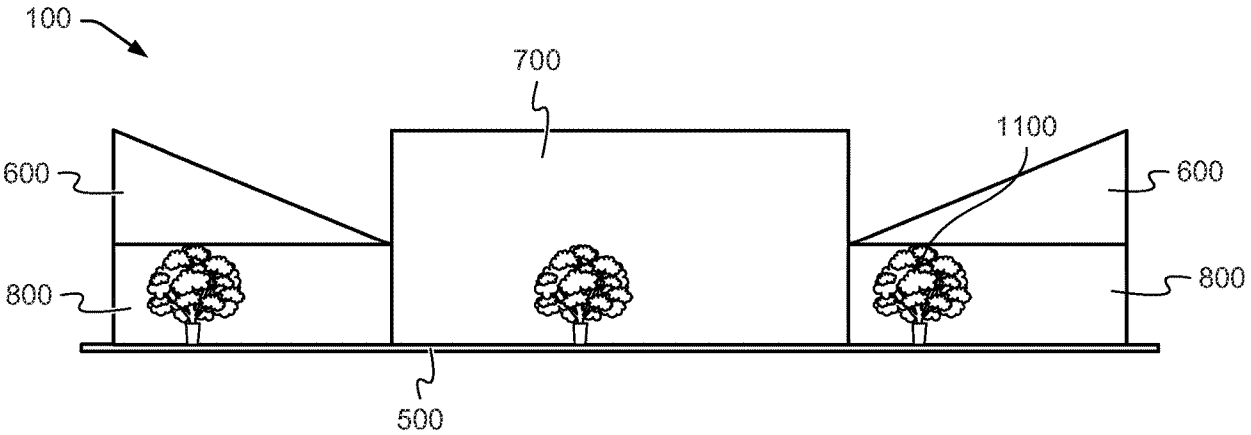
FIG. 3B depicts a right view of a representation of an embodiment of a food tray kit.
Figure 4:
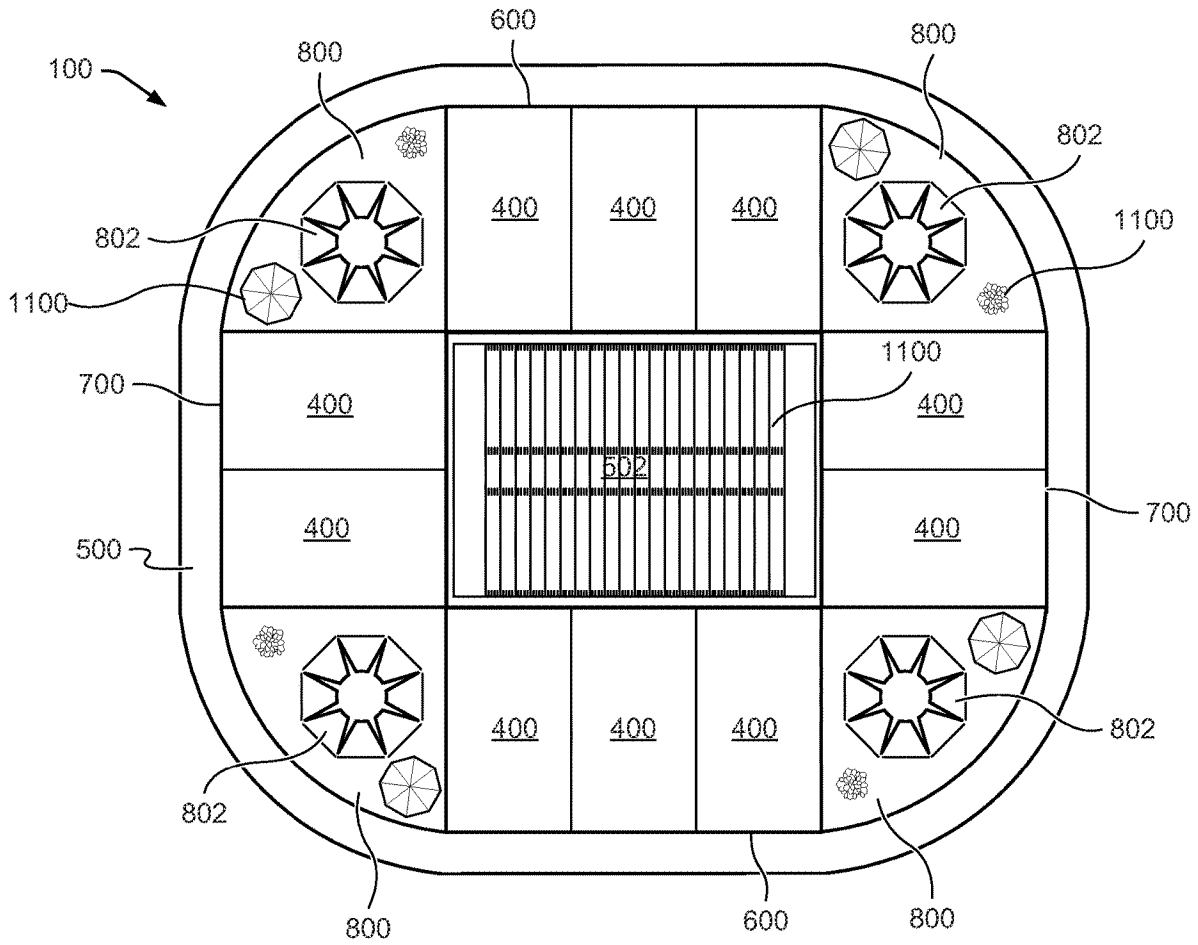
FIG. 4 depicts a top view of a representation of an embodiment of a food tray kit.
Figure 5:
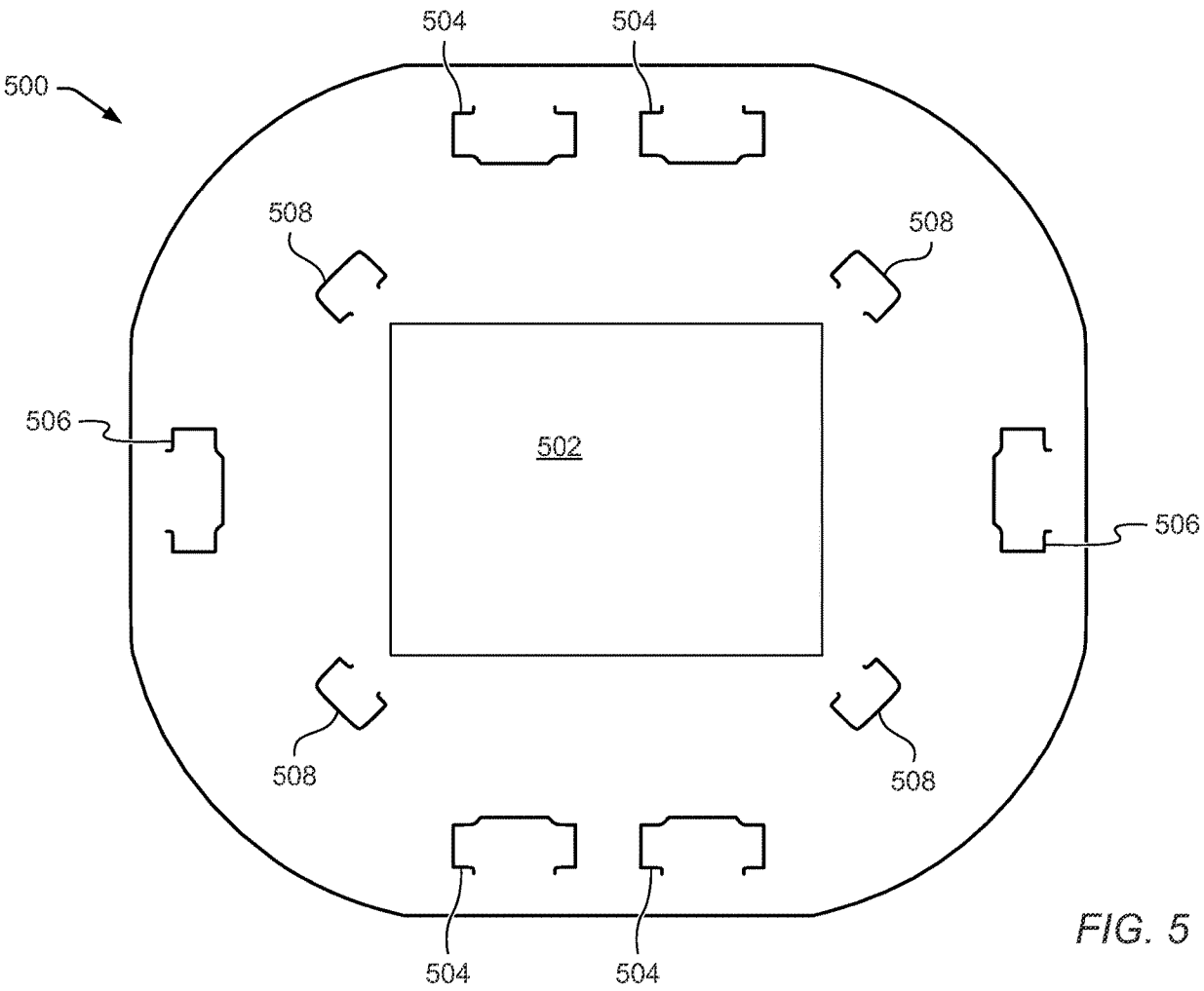
FIG. 5 depicts a bottom view of a representation of an embodiment of a food tray kit.

In some embodiments, a system and/or method may include a food tray kit 100. In some embodiments, the food tray kit may include a platform 500, a plurality of first foldable containers 600-700, a plurality of second foldable containers 800, and a third container 502. FIG. 1 depicts a perspective view of a representation of an embodiment of a food tray kit 100. FIGS. 2A-B depict a front perspective and a rear view respectively of a representation of an embodiment of a food tray kit 100. FIGS. 3A-B depict a left view and a right view respectively of a representation of an embodiment of a food tray kit 100. FIGS. 4-5 depict a top view and a bottom view respectively of a representation of an embodiment of a food tray kit 100.

Figure 6A:
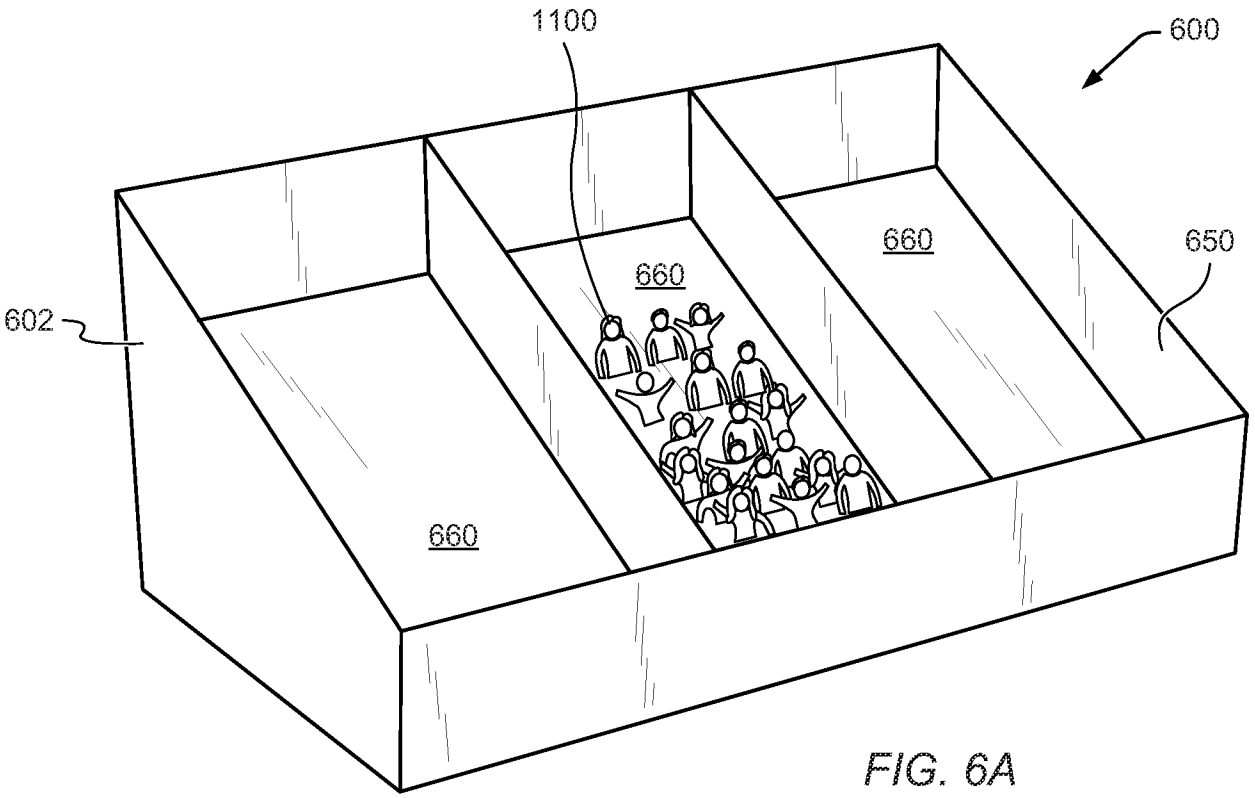
FIG. 6A depicts a front perspective view of a representation of an embodiment of a first foldable container of a food tray kit in an assembled state.
Figure 6B:
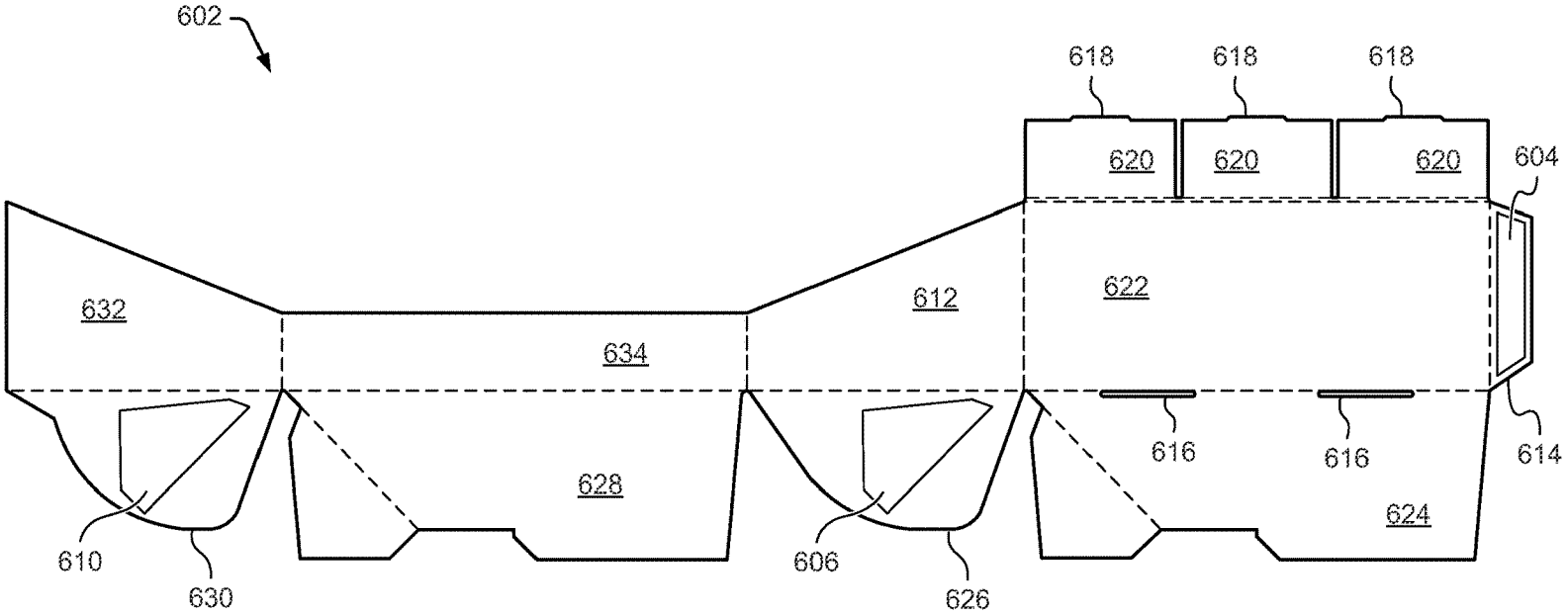
FIG. 6B depicts a top view of a representation of an embodiment of a portion of a first foldable container of a food tray kit in a disassembled state.
Figure 7A:
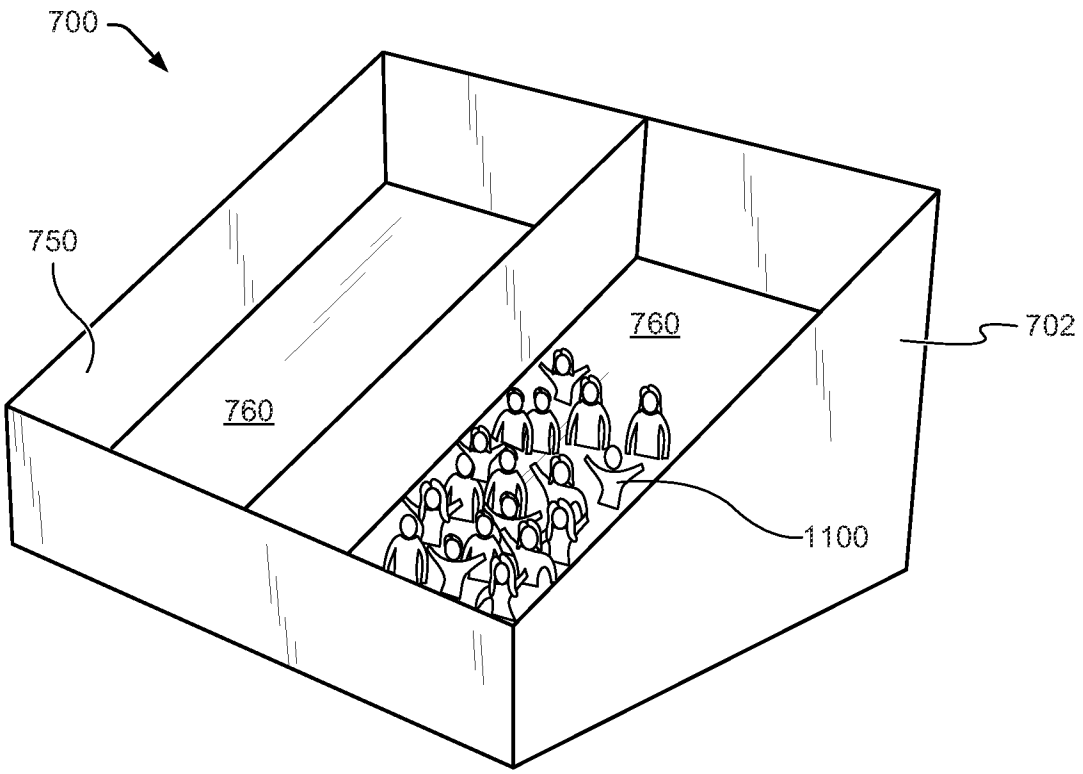
FIG. 7A depicts a front perspective view of a representation of an embodiment of a first foldable container of a food tray kit in an assembled state.
Figure 7B:
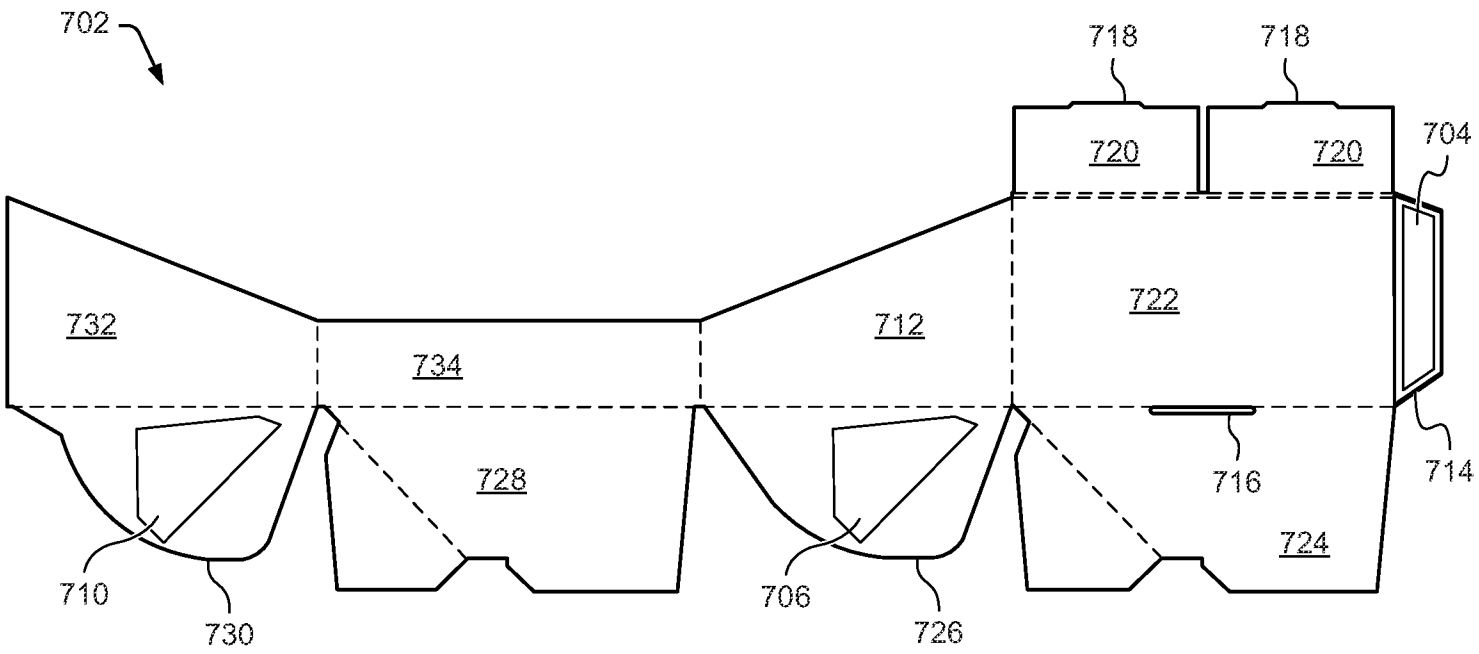
FIG. 7B depicts a top view of a representation of an embodiment of a portion of a first foldable container of a food tray kit in a disassembled state.
Figure 7C:
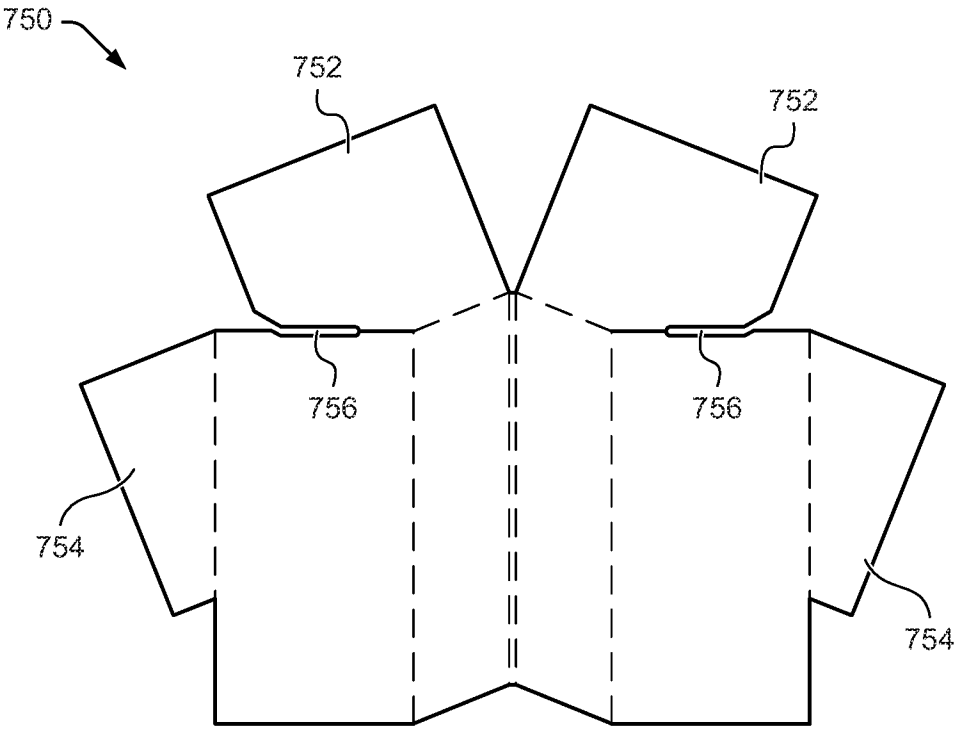
FIG. 7C depicts a top view of a representation of an embodiment of a divider of a first foldable container of a food tray kit in a disassembled state.

In some embodiments, the first containers 600, 700 may be foldable such that they may be able to form a plurality of different shapes. A first shape may include a substantially flat form. The substantially flat form may allow a food tray kit to be transported more readily (e.g., especially as regards shipping over long distance to customers). In some embodiments, the first containers 600, 700 may be formed from a multiple separate portions which couple to one another to form the first containers 600, 700. In some embodiments, the first containers 600, 700 may be formed from two portions. A first portion 602, 702 may include a substantially flat first shape (e.g., as depicted in FIGS. 6B, 7C). The first portion may form a second shape during use. The second shape may form an exterior perimeter of the first containers 600, 700 (e.g., as depicted in FIGS. 6A, 7A). In some embodiments, the first portion may include a system for assembling the first portion. Adhesive tabs (e.g., tabs 606 and 610 as depicted in FIG. 6B and tabs 706 and 710 as depicted in FIG. 7B) may include a preapplied adhesive which when pressed against an interior surface (e.g., tabs 626 and 630 as depicted in FIG. 6B and tabs 726 and 730 as depicted in FIG. 7B) inhibits disassembling. The tabs may fit into the openings forming and holding the shape of the first portion (e.g., sides 632, 634, 612, 622 forming a perimeter and sides 624 and 628 forming a bottom of the first container 600 and sides 732, 734, 712, 722 forming a perimeter and sides 724 and 728 forming a bottom of the first container 700) of the first container 600. An adhesive tab 614, 714 may include a preapplied adhesive 604, 704 which when pressed against an interior surface of 632, 732 inhibits the first portion from disassembling.

Figure 6C:
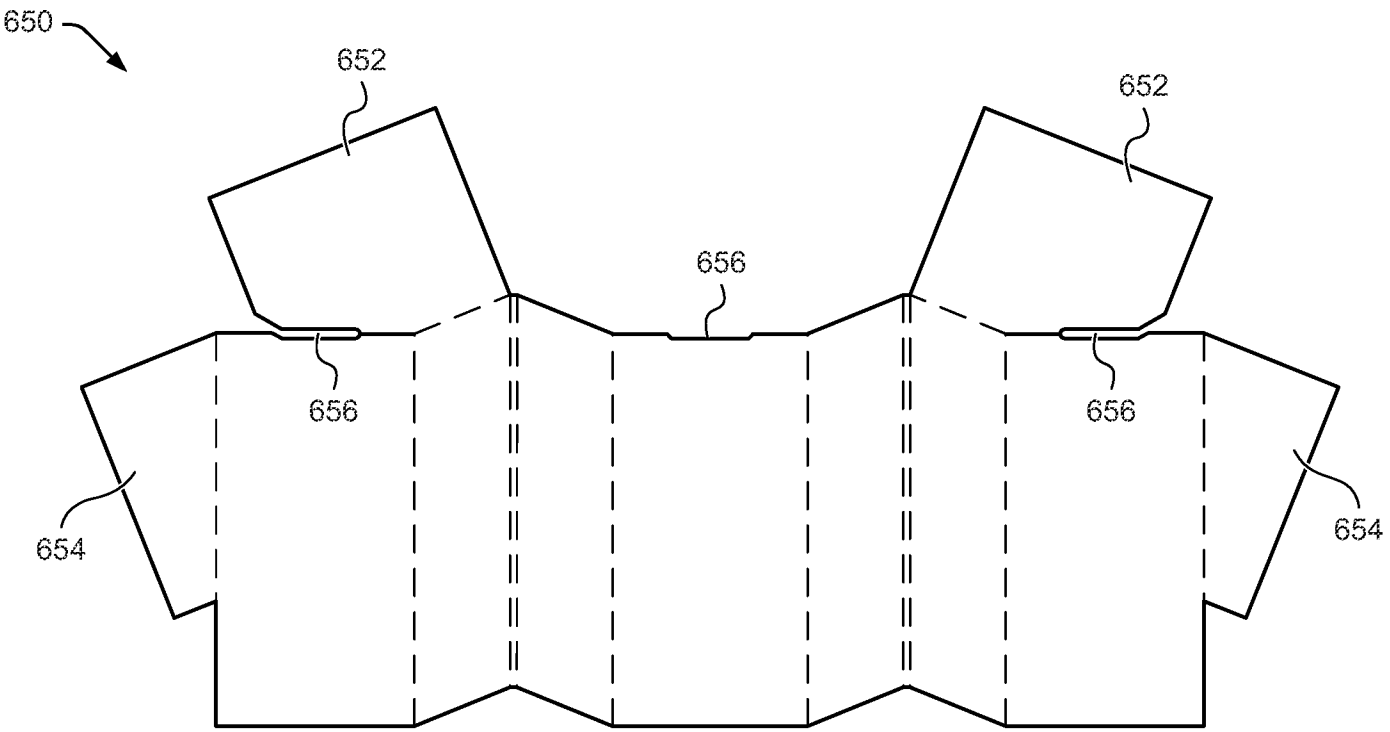
FIG. 6C depicts a top view of a representation of an embodiment of a divider of a first foldable container of a food tray kit in a disassembled state.

The second portion 650, 750 may include a substantially flat first shape (e.g., as depicted in FIGS. 6C, 7C). The second portion may form a second shape during use. The second shape may form an interior divider 650, 750 of the first containers 600, 700 (e.g., as depicted in FIGS. 6A, 7A). The second portion may include embodiments that form differently sized and/or numbers of containers 660, 760 within the first portion. In some embodiments, the kit 100 may include different second portions for each first portion allowing a user options for what size number of containers are available to the first containers. The first containers in a kit 100 may include differently sized containers (e.g., as depicted in FIGS. 6B, 7C). The second portion may fold in upon itself to form the dividers and bottom of the containers of the first containers. Sides 652, 654 and 752, 754 may support the second portion within the first portion at an appropriate angle for first containers 600, 700 respectively. Once the second portion is positioned in the first portion sides 620 may fold over such that tabs 618 fit into slots 656 coupling the two portions together for first container 600. Once the second portion is positioned in the first portion sides 720 may fold over such that tabs 718 fit into slots 756 coupling the two portions together for first container 700.

In some embodiments, at least some of the plurality of first foldable containers 600, 700 may include an opening cut at an angle to resemble a portion of a sports entertainment stadium. The opening may be cut at an angle to resemble bleachers in a sporting stadium or a sporting venue.

In some embodiments, at least some of the plurality of first foldable containers 600, 700 may contain, during use, food. Food items may include any type of food but typically may include party snack foods (e.g., chips, pretzels, cookies, crackers, vegetables, etc.). In some embodiments, a kit 100 may include separate liners. Liners may be positioned in containers to inhibit liquids and/or food particles from leaking through the containers. Liners may allow liquids (e.g., dips, salsas, etc.) to be contained in the food containers. Liners may be formed from plastic. In some embodiments, users may use their own containers (e.g., liquid impermeable containers) which are positionable in the containers of the kit 100.

Figure 8A:
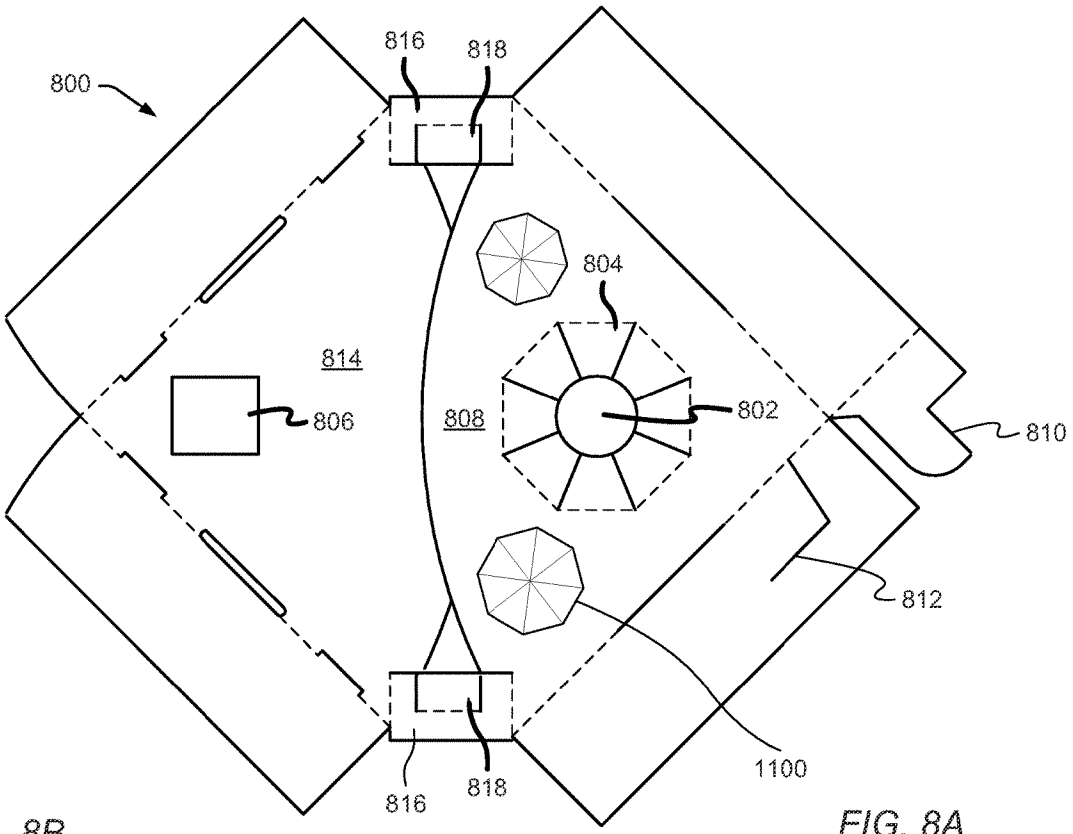
FIGS. 8A-B depict a top view of a representation of an embodiment of a second foldable container of a food tray kit in a disassembled state.
Figure 8B:
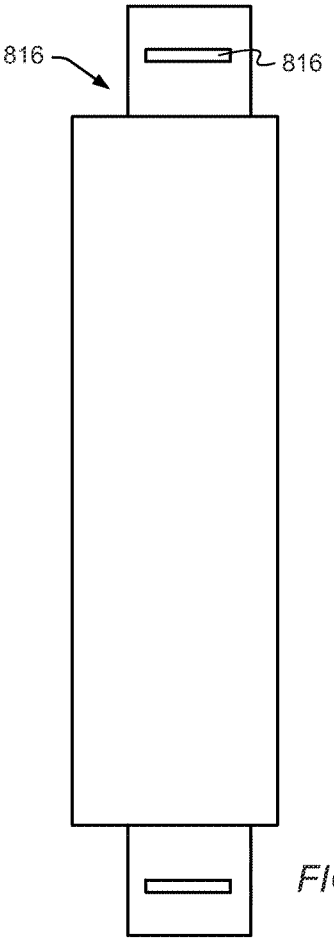

In some embodiments, the second containers 800 may be foldable such that they may be able to form a plurality of different shapes. A first shape may include a substantially flat form. The substantially flat form may allow a food tray kit to be transported more readily (e.g., especially as regards shipping over long distance to customers). In some embodiments, the second containers 800 may be formed from a multiple separate portions which couple to one another to form the second containers 800. In some embodiments, the second containers 800 may be formed from a single portion (e.g., as depicted in FIG. 8A). In some embodiments, the second containers 800 may include a substantially flat first shape (e.g., as depicted in FIG. 8A). The second containers 800 may form a second shape during use (e.g., as depicted in FIG. 1). In some embodiments, the second containers may include a system for assembling. The system may include an opening (e.g., opening 812 as depicted in FIG. 8A) and a tab (e.g., tab 810 as depicted in FIG. 8A). The tabs may fit into the openings forming and holding the shape of the second containers 800. In some embodiments, a spacer 816 (e.g., as depicted in FIG. 8B) may function to hold sides 808 and 814 apart at least on one end. In some embodiments, an opening 818 (e.g., as depicted in FIG. 8B) in the spacer 816 may accept tabs from an elongated portion which covers the opening between sides 808 and 814 once assembled (the elongated portion may serve only as decorative in some embodiments).

The second containers 800 may include embodiments that form differently sized and/or numbers of openings 802 (e.g., as depicted in FIG. 8). The openings may be configured to hold separate food containers positionable in the openings. An opening may include a system to inhibit the separate container from dislodging from the opening. The system may include tabs 804 which press against the separate container forming a friction fit with the separate container. At least some of the plurality of second foldable containers include an adjustable opening which adjusts to different sized food containers. In some embodiments, the tabs may be initially coupled to one another, for example, with frangible breaks which may be only decoupled partially to accommodate differently sized containers.

In some embodiments, at least some of the plurality of second foldable containers 800 may contain, during use, food. Food items may include any type of food but typically may include party snack foods (e.g., chips, pretzels, cookies, crackers, vegetables, etc.). In some embodiments, the second foldable container may include an opening(s) 802 into which separate food containers may be positioned (e.g., containers of food, drink containers). In some embodiments, users may use their own containers (e.g., liquid impermeable containers) which are positionable in the containers of the kit 100.

In some embodiments, a third container 502 may contain, during use, food. Food items may include any type of food but typically may include party snack foods (e.g., chips, pretzels, cookies, crackers, vegetables, etc.). In some embodiments, the third container 502 may be formed from portions of the first foldable containers (and/or the second foldable containers) upon coupling to the platform 500.

Figure 9:
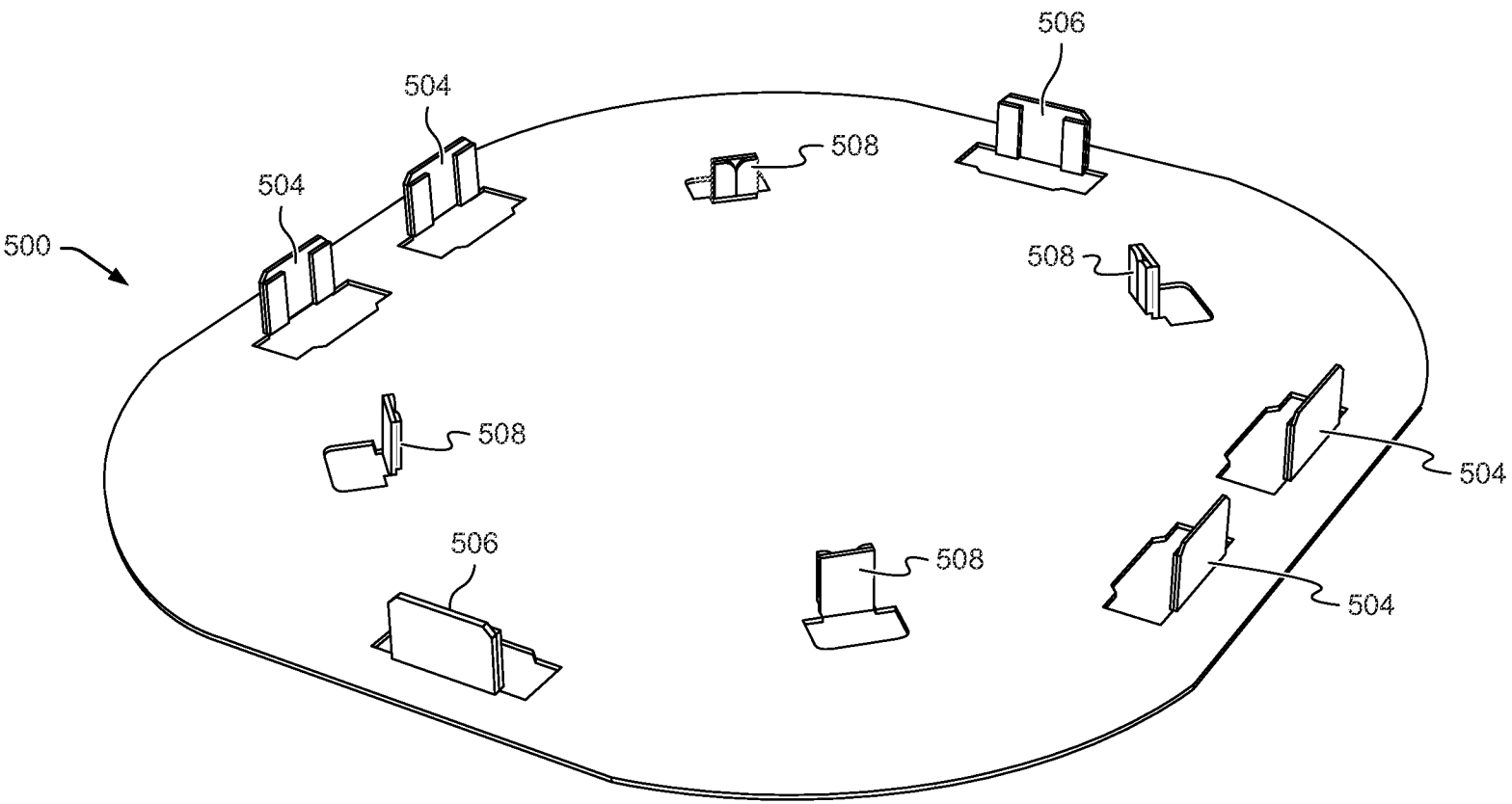
FIG. 9 depicts a perspective view of a representation of an embodiment of a platform of a food tray kit with tabs extended.

In some embodiments, the kit 100 may include a platform 500 (e.g., as depicted in FIG. 9). The platform may be shipped substantially flat. The platform may be foldable in order to facilitate shipping by reducing the footprint of the platform during shipping.

Figure 11:
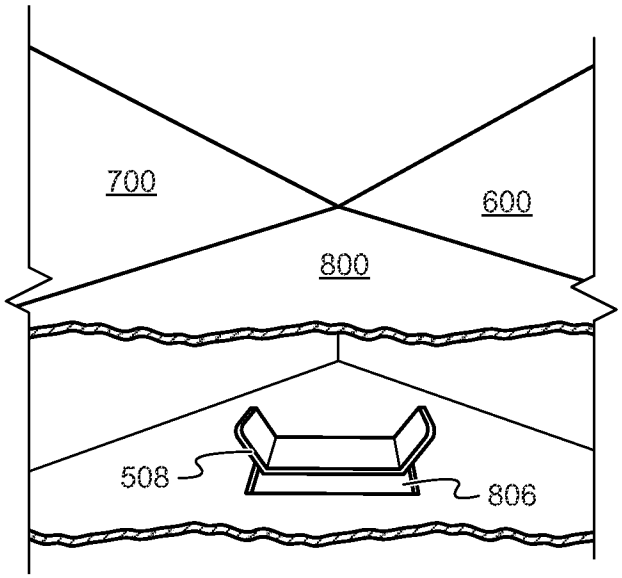
FIG. 11 depicts a perspective view of a representation of an embodiment of a platform of a food tray kit with tabs in a locking position extending into an opening.
Figure 10:
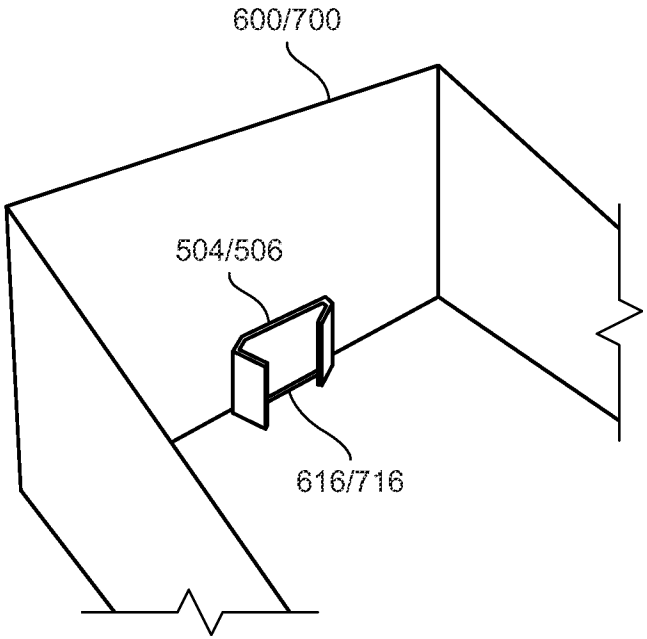
FIG. 10 depicts a perspective view of a representation of an embodiment of a platform of a food tray kit with tabs in an insertion position extending into an opening.

The plurality of first foldable containers 600, 700 may be couplable to the platform 500. The plurality of second foldable containers 800 may be couplable to the platform 500. In some embodiments, a kit may include a system for coupling one or more of the foldable containers to the platform. The system may include an opening (e.g., openings 616, 716, and 806 as depicted in FIGS. 6B, 7B, and 8 respectively) and a tab (e.g., tabs 504, 506, and 508 (listed in order with respect to the openings) as depicted in FIG. 9). The tab may include a first shape and a second shape. The first shape may be conveyable, during use, through the opening (e.g., as depicted in FIG. 9). The second shape may be inhibited, during use, from conveyance through the opening (e.g., as depicted in FIGS. 10-11). The second shape may be achieved by bending or deforming (e.g., along prepressed lines) the tab so as the tab is inhibited through the openings.

In some embodiments, the food tray kit may include indicia and/or embossing which facilitate a user's perception of the food tray kit as a generally recognizable structure for a targeted consumer group. Indicia may include elements of a sporting stadium, a sports field, and/or sporting event. In some embodiments, the third container may include indicia emulating a sports field (e.g., as depicted in FIG. 4). In some embodiments, indicia may include elements 1100 associated with sports themed stadiums/events (e.g., fans, plants, shade umbrellas as depicted in FIGS. 1-4, 6A, 7A, and 8). In some embodiments, at least some of the plurality of first foldable containers may include indicia emulating at least a portion of a sports entertainment stadium (e.g., a specific stadium and/or event. In some embodiments, at least some of the plurality of second foldable containers may include indicia emulating at least a portion of a sports entertainment stadium.

Figure 12:
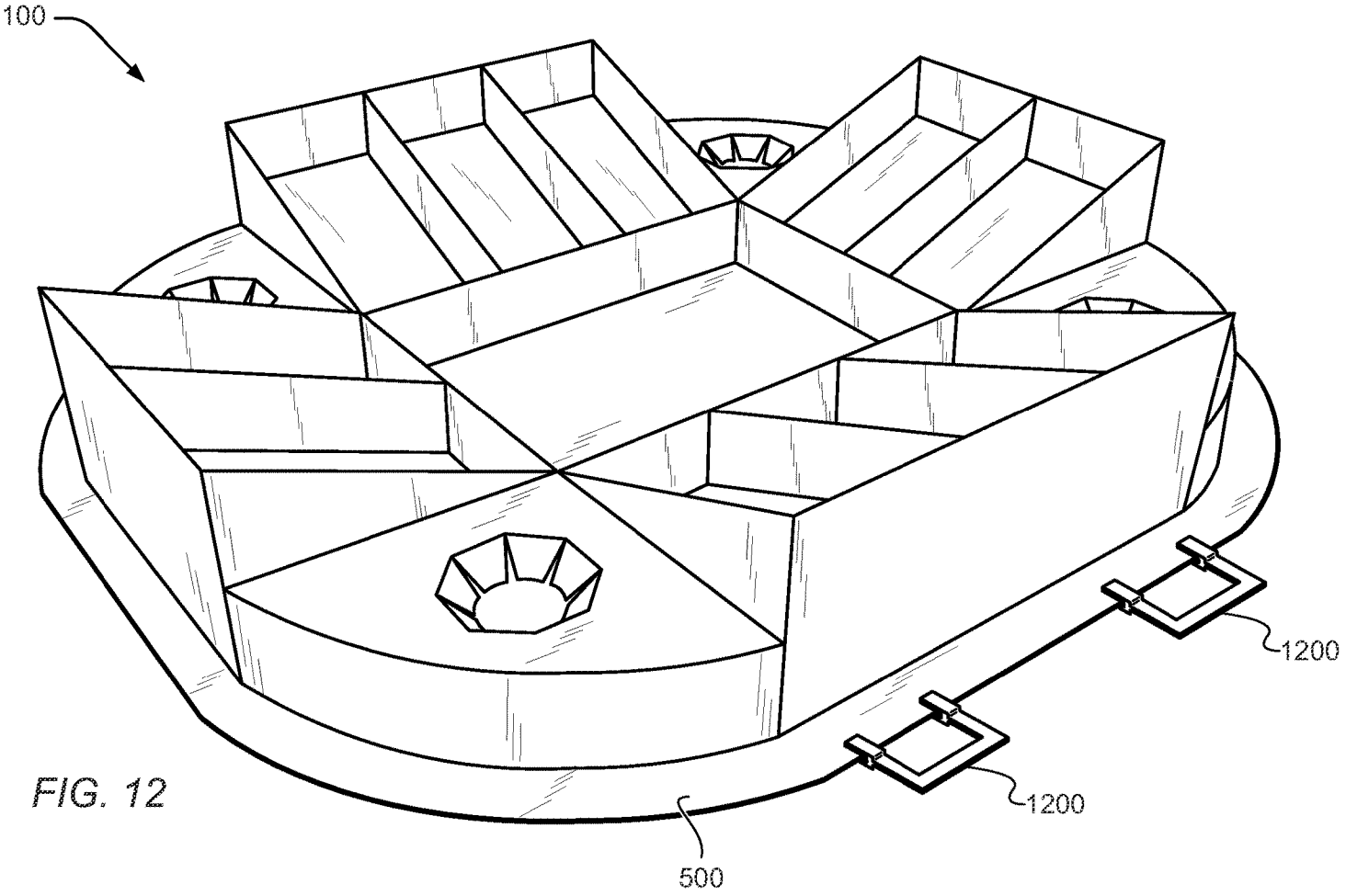
FIG. 12 depicts a perspective view of a representation of an embodiment of a food tray kit including handles.

In some embodiments, the food tray kit 100 may include a system or device which facilitates the transport of the food tray kit once assembled. The device may include handles 1200 coupled to platform 500 (e.g., as depicted in FIG. 12). Handles 1200 may be formed from a sturdier material than the kit in order to bare the weight of the food kit as well as any food placed in the containers of the food kit. The device may include openings in the platform which functions as handles. The openings may be reinforced.

In some embodiments, at least a portion of the food tray kit may be formed from one or more paper products (e.g., cardboard, pressed board, paper, etc.) or a polymer (e.g., plastics, etc.). In some embodiments, at least one surface of at least one portion of the kit includes a coating which inhibits, during use, absorption of liquids (e.g., water). The food tray kit may be formed from food safe products (or at least portions of the food kit which are configured to contact food products.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A method of forming a food tray, comprising:

folding a plurality of individual first foldable containers to couple at least a first portion to a second portion and form the plurality of first foldable containers into a second shape, which contains food during use, from a first flat shape, wherein the plurality of first foldable containers comprise an opening cut at an angle to form at least a portion of a sports entertainment stadium;

folding a second foldable container to couple at least a first portion to a second portion and form the second foldable container into a second shape, which contains at least one food container during use, from a first flat shape;

coupling the second foldable container to a surface of a two-dimensional platform, wherein the second foldable container is inhibited from separating from the surface of the platform; and forming a third container by coupling at least some of the plurality of individual first foldable containers to the surface of the platform, wherein the first foldable container is inhibited from separating from the surface of the platform, wherein the individual first foldable containers form all four sides of the third container, which is an open container, when coupled to the surface of the platform and the surface of the platform forms a bottom of the third container, the third container being at least partially positioned between at least two individual first foldable containers, and wherein the third container forms at least a portion of a sports field of the sports entertainment stadium, wherein the third container comprises indicia on the bottom surface of the third container forming boundaries and playing field markings of a sports field;

wherein the first and/or second foldable containers comprise an opening and the platform comprises a foldable tab comprising a first shape and a second shape, wherein the first shape is conveyable, during use, through the opening and the second shape is inhibited, during use, from conveyance through the opening, wherein the platform is coupled to the first/second foldable containers once the second shape is activated after passing through the opening.

2. The method of claim 1, wherein the third container comprises indicia on the surface of the platform forming boundaries of a sports field.

3. The method of claim 1, wherein at least some of the plurality of first foldable containers comprise indicia depicting at least a portion of a sports entertainment stadium.

4. The method of claim 1, further comprising inhibiting removal of the at least one food container using portions of the second foldable container.

5. The method of claim 1, further comprising adjusting an adjustable opening of the second foldable container to accommodate different sized food containers.

6. The method of claim 1, wherein the second foldable container comprises indicia depicting at least a portion of a sports entertainment stadium.

7. The method of claim 1, further comprising inhibiting absorption of water using a coating applied to at least one surface of at least one portion of the kit.

* * * * *